United States Patent [19]

Weber et al.

[11] Patent Number: 4,556,309

[45] **Date of Patent: * Dec. 3, 1985**

[54] ELECTROPHOTOGRAPHIC IMAGING APPARATUS, PARTICULARLY FOR COLOR PROOFING AND METHOD

[75] Inventors: Harold J. Weber, Sherborn, Mass.; Manfred R. Kuehnle, New London, N.H.; Kenneth D. Fraser, Scarborough, Canada; Kenneth A. Lindblom, Shrewsbury, Mass.

[73] Assignee: Coulter Systems Corporation, Bedford, Mass.

[ * ] Notice: The portion of the term of this patent subsequent to Nov. 27, 2001 has been disclaimed.

[21] Appl. No.: 454,480

[22] Filed: Dec. 29, 1982

[51] Int. Cl.[4] ..... G03G 15/14

[52] U.S. Cl. ..... 355/3 TR; 355/12; 355/14 TR

[58] Field of Search ..... 355/3 R, 3 TR, 3 TE, 355/12, 14 TR

[56] References Cited

U.S. PATENT DOCUMENTS

| | | | |
|---|---|---|---|
| 3,040,621 | 6/1962 | Crumrine | 355/3 R |
| 3,115,814 | 12/1963 | Kaprelian | 355/3 TE |
| 3,653,891 | 4/1972 | Thourson et al. | 355/3 TE X |
| 3,761,174 | 9/1973 | Davidson | 355/12 X |
| 4,358,195 | 11/1982 | Kuehnle et al. | 355/4 |

*Primary Examiner*—Fred L. Braun

*Attorney, Agent, or Firm*—Silverman, Cass & Singer, Ltd.

[57] ABSTRACT

Apparatus and method for producing color proofs electrophotographically. A platen carrying an electrophotographic member is translated sequentially past functional stations including a charging station, an exposure station, a toning station, a transfer station and a cleaning station. Once toning is completed, the platen carrying the toner image is translated to the transfer station. An intermediate transfer medium is disposed at the transfer station as the sole receptor of the toner image from the electrophotographic member. A roller effects transfer engagement between the intermediate transfer medium and the toner image carrier. Direct transfer mode or offset transfer mode electively is provided at the transfer station. For offset mode, the toner image on the photoconductive layer involves first transfer to the intermediate transfer medium and from the latter to the transfer medium. The direct transfer mode is effected by employing, as an intermediate transfer medium, the same material as the transfer medium. Successive color separation transparencies are substituted in sequence respectively to form the finished color proof.

39 Claims, 8 Drawing Figures

ELECTROPHOTOGRAPHIC IMAGING APPARATUS, PARTICULARLY FOR COLOR PROOFING AND METHOD

BACKGROUND OF THE INVENTION

This invention relates generally to electrophotographic imaging and more particularly, provides improved apparatus and methodology for electrophotographically producing color proofs for either direct or offset transfer from color separated transparencies.

Color proofs are needed to show the printing craftsman the results of color separation and whether the corrected separations are suitable for plate making. Of considerable importance is the simulation or prediction of the appearance of the final printed copy on the particular medium used for the final print-run. Proofs are especially needed at two stages in the printing process and are divided into two primary groups, i.e., separation proofs and pre-press proofs.

Separation proofs are made directly by the photoreproduction apparatus to determine the results of the separation process and the identity and character of any corrections needed. Of considerable importance is the capability of accurate and reproducible evaluation of factors such as color balance, tone reproduction, shadow detail, image sharpness, and contrast, among others. Economy and speed in making such proofs are sought after goals in color proofing. Equally important are reliability, reproducibility and predictability. The proof must reproduce the color separation film exactly without distortion or loss. Exact replicas of the printing ink characteristics should be reproduced so that overprinting colors will be the same on the proofs as they are with printing inks employed on the printed sheet.

Pre-press proofs are made from the final corrected separation transparencies. The pre-press proof is intended to reproduce the result which will be obtained using the printing press, indicating the effects of the paper surface, ink strength, gloss, etc. The pre-press proof should show the same printing characteristics as the finished printed result.

The paper surface has an important effect on the appearance of the finished print and, in particular, the critical characteristics of said surface which affect the resultant print are color, ink absorbency and gloss. Color proofs can be made which simulate the effects of paper color. The effects of ink absorbency and gloss are complex and difficult to duplicate. Prints on newsprint lack contrast, are muddy in the middle tones and the inks applied thereto are dull. Prints on uncoated papers have improved contrast compared to prints on newsprint but the inks are still dull with middle tones dark and shadows lacking detail. Coated papers also result in different contrast, gloss, tone characteristics, etc. Thus a proof should be made on the actual paper which is to constitute the substrate carrying the finished printed image.

Several photomechanical processes for prepressproofing are available. These systems fall into two categories, namely, overlay systems and superimposition systems.

Overlay systems consist of a set of transparent light sensitive films which are dyed or pigmented to simulate the four process colors, yellow, cyan, black and magenta. Each screened separation is exposed to the appropriate film and developed chemically. After development, four separate images are produced which are superimposed in register. The result is viewed as a transparency. These are generally employed where a quick and inexpensive proof is required and normally are not a satisfactory match for the printed reproduction. The whites are gray and the result, very glossy, suffering from internal reflections between film layers which generally cause color changes in overprinted colors. They are economical to produce, require no special equipment and are extensively used for internal checking.

Superimposition systems involve the production of an image on an integral backing sheet either specific to the process or of the type on which the final print will be made. These processes include the Cromalin process of DuPont Co., the Transfer Key process of Minnesota Mining and Manufacturing Corporation, the Gevaproof process of Agfa-Gevaert and the Remak process of Chemical Corporation of Australia, Pty. Ltd.

The Cromalin process involves the lamination of a tacky, transparent, photopolymer film to a base sheet under heat and pressure. The film is hardened by exposure to ultraviolet light. The protective cover sheet is removed and toning powder of the appropriate color is dusted over the surface. The toner adheres only to the areas where no exposure has been received and the polymer remains tacky. The proof is produced by repeating this procedure four times, once for each separation. The base material is a heavy kraft, coated paper or a paperboard member, thus requiring specially made stock.

The Transfer Key process can employ any base stock. A set of four transparent light sensitive films are supplied which have been pigmented to simulate the four process colors. These films are coated with a pressure sensitive adhesive and may be adhered to a base stock to form the laminate. The exposed image is polymerized by exposure to ultraviolet light. The unhardened areas are removed by a solvent with the proof being built up one layer at a time. This process can be improved by producing the layers on a transparent base which in turn is laminated to a base sheet using a spacer to simulate dot gain.

The Gevaproof process also uses laminations to a base stock similar to the Transfer Key process.

The REMAK process is an electrostatic process wherein a sheet of paper coated with a zinc oxide/resin binder composition is charged electrostatically and exposed to light through a color separated transparency. The exposed sheet is immersed in a liquid toner bath and electrophoretically toned. The resulting visible image is transferred to any base stock or, alternatively, the proof may be built up by successive exposures and toning on the original base material. Unfortunately, the zinc oxide photoconductor used with the REMAK process is extremely sensitive to changes in temperature and relative humidity, as well as variations in toner lots.

Many of the problems of prior art proofing methods have been solved by the invention of U.S. Pat. No. 4,358,195. This patent discloses a method and apparatus which takes advantage of the high speed response of an electrophotographic member using a flat-bed machine having plural stations sequentially arranged linearly along a framework. A color separation transparency is mounted on a copyboard and presented to a charged electrophotographic member; the transparency is superposed and exposed to a light source. The carrier for the electrophotographic member was manipulated, i.e., pivotally inverted, and presented to a movable toning station. The toned member is again inverted for presentation to a transfer means effective to transfer the toned image to a sheet of print stock. The process can be repeated with different separations and toners with registration being obtained by registration means provided for properly positioning both the color separation and electrophotographic medium.

Another improved apparatus and method is provided by the invention disclosed in pending patent application Ser. No. 348,769 filed Feb. 16, 1982 and assigned to the same assignee as the subject application. The referenced application discloses electrophotographic imaging apparatus, particularly for color proofing, that is provided for normal daylight operation and includes: a light-tight housing having a framework mounting plural functional processing stations comprising, a charging station, an imaging or exposure station, a toning station, an image transfer station and a cleaning station, all interior of the housing. The apparatus of said pending application is primarily for producing color proofs for direct transfer technology.

Methods are known in which a developed electrostatic latent image is transferred to an intermediate member and subsequently transferred therefrom to an image receiving member. U.S. Pat. No. 3,862,848 provides an example of prior electrophotographic systems wherein the developed electrostatic latent image is transferred to the working surface of an intermediate member and subsequently is transferred to an image receiving surface. The intermediate member has an electrically conductive working surface which facilitates both the first and second transfer steps by the concurrent physical contact and application of an electrostatic field.

U.S. Pat. No. 4,182,266 describes an offset mode of transfer wherein an image deposit is transferred to an intermediate or offset member and thereafter, transferred to a transfer receiving member. The transfer steps are effected by the simultaneous contact and application of an electrostatic field. This patent describes a method and means for effecting transfer to a flexible or rigid transfer receiving member, such as metal plates of the type commonly used in lithographic printing.

As may be appreciated from the above, the limitations of the prior art are as follows:

1. The apparatus of the referenced patent and patent application provide for direct transfer, without offset transfer capability.
2. The intermediate member is required to have an electrically conductive working surface.
3. A correct reading color proof or print cannot be produced selectively by direct transfer or offset transfer using the same apparatus without employing a transparency of the opposite sense, i.e. by using a negative transparency instead of a positive transparency.
4. A single apparatus cannot selectively produce a correct reading color proof by direct transfer and/or offset transfer on the same kind of substrate as the printing substrate or stock.

The herein invention resolves the problems of the prior art as recited herein.

SUMMARY OF THE INVENTION

Apparatus and method for producing a print copy of a graphic art image from a transparency carrying said image in an emulsion side thereof using electrostatic techniques. A carriage carrying a platen is translated along a horizontal linear path sequentially past functional stations including a charging station, an imaging or exposure station, a toning station, an image transfer station and a cleaning station, all contained within said housing. The platen having upper and lower planar surfaces is rotatably mounted on the carriage. An electrophotographic member is secured to the lower planar surface such that the photoconductive layer thereof normally faces inwardly into the housing. A transfer medium is secured to the upper planar surface. A copyboard is located at the imaging station and means is provided for mounting a selected transparency thereupon. A toning module, including a sump with liquid toner, and a generally planar development electrode and means for flowing liquid toner across the development electrode are provided. The toning module normally is seated at one level and is lifted to a second level to place the development electrode in toning proximity with the photoconductive layer of the electrophotographic member when it arrives at the toning station on the traversing carriage. The carriage is translated past a corona generating device at the charging station for application of an electrostatic charge potential to the photoconductive layer of the electrophotographic member. After sufficient charge has been applied to said layer, the carriage is translated above the copyboard that is raised to establish intimate engagement with the charged layer and the emulsion side of the transparency. Radiant energy from a source located below the copyboard is projected to the charged layer through the transparency to form a latent electrostatic charge image on said layer. The copyboard is lowered to free the carriage. The carriage then is translated to the toning means where the latent electrostatic image is toned. The carriage is translated above the transfer station and stopped. At the transfer station, an intermediate transfer medium, such as conventional paper material, in sheet or web form, is mounted on a suitable mounting and disposed interior of the housing. Means are provided to apply a selected amount of electrical insulating liquid to the intermediate member before transfer is effected, roller means being provided to effect transfer engagement between the intermediate member and the downwardly facing photoconductive layer. The platen is rotated through 180 degrees so that the transfer medium faces downwardly. The roller means effects a transfer engagement between the intermediate transfer medium and the downwardly facing transfer medium for transfer of the toner image to said transfer medium. The platen is rotated through 180 degrees to its initial planar orientation.

Direct or offset transfer selectively can be provided without material change in the apparatus. For direct transfer, the toner image on the photoconductive layer is transferred directly to said intermediate transfer medium which would be formed of the same material as that used for the transfer medium.

Means for applying an electrical bias voltage during both the toning and the transfer steps are provided to assist in said toning and transfer respectively. Subsequent to transfer, the carriage is returned to its home position, in the course of which, the platen passes a cleaning station at which means are provided for removing any residual toner remaining on the photoconductive layer subsequent to transfer as well as to discharge any residual charge potential which may have remained thereon.

A different one of the primary color proof colors, such as yellow, cyan, magenta and black, corresponding to each different color separation transparency is substituted sequentially.

DESCRIPTION OF PREFERRED EMBODIMENTS

Figure 1:
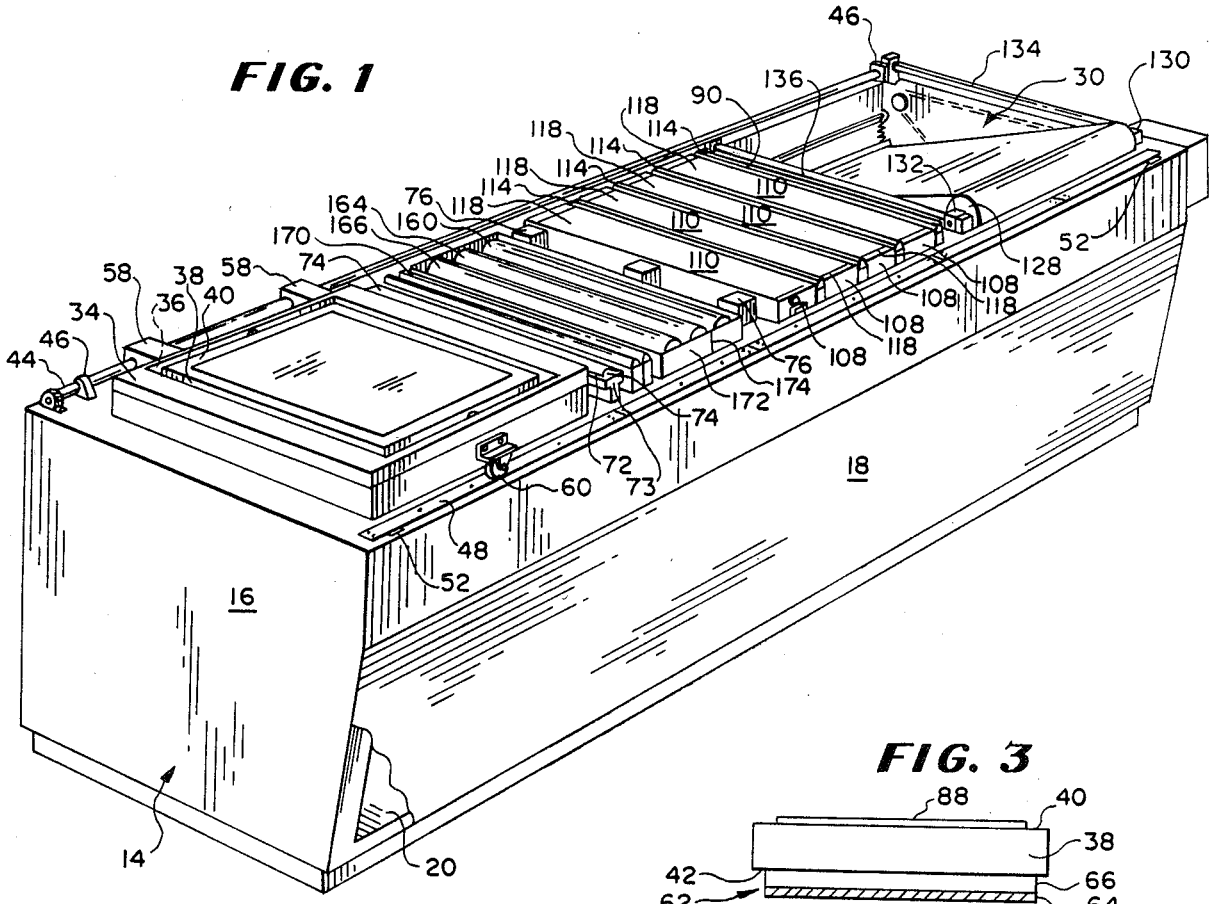
FIG. 1 is a perspective view of color proofer apparatus constructed in accordance with the invention.
Figure 2:
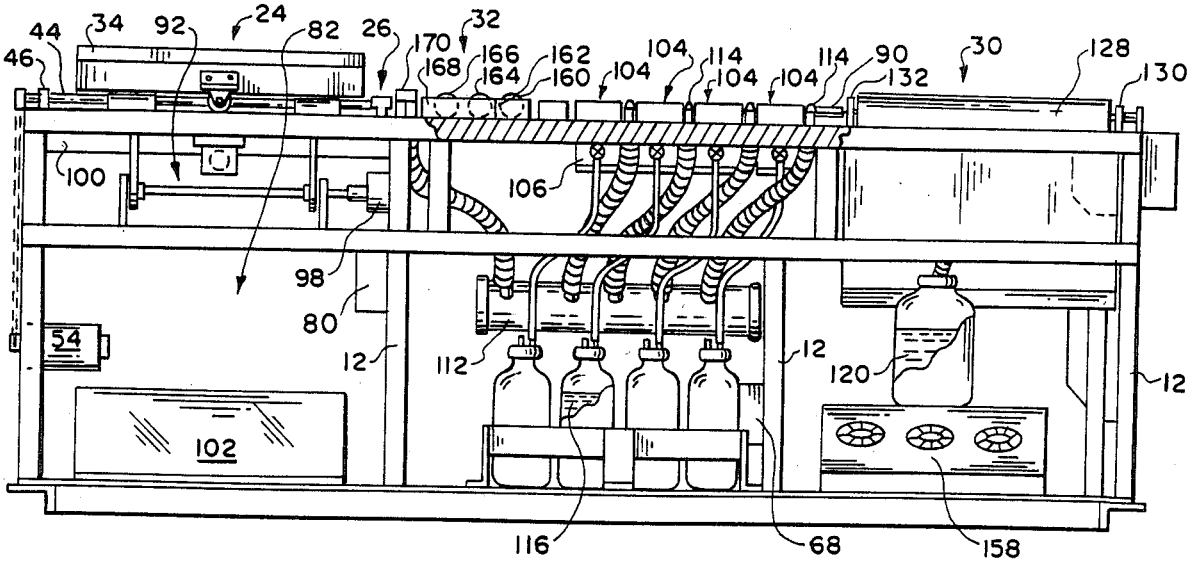
FIG. 2 is a front elevational view of the apparatus of FIG. 1 with a portion of the housing removed.

Referring to FIGS. 1 and 2, the electrophotographic imaging machine embodying the invention is designated generally by the reference character 10; said machine 10 has a generally open, box-like framework formed of robust, steel, structural members 12 mounting panel members to form a light-tight housing 14. Housing 14 has opposite end walls 16, opposite side walls 18 and a base 20. A rectangular top frame 22 completes the housing 14. The functional or processing stations required for the electrophotographic processing are disposed within the interior of the housing 14 and include an imaging or exposure station designated 24, a charging station designated 26, a toning station designated 28, an image transfer station designated 30 and a cleaning station designated 32.

A carriage 34 having a generally rectangular configuration is provided with a generally rectangular window 36 in which a platen 38 is rotatably mounted. The platen 38 has a planar, upper sheet-receiving surface 40 facing outwardly of the housing 14 and a planar, lower electrophotographic member-receiving surface 42 facing downwardly toward the interior of the housing 14. A guide rail 44 is journalled in opposite blocks 46 secured on the top frame 22 at opposite ends of the housing and extending along the length of the frame 22. A track 48 is secured along the opposite side of the top frame 22, also extending along the length of the same.

Mounted in the upper portion of the housing 14 is a subchassis designated 50 in FIG. 2. Subchassis 50 carries the top frame 22 and rail 44. Alignment compensation shims 52 are used to adjust and set the desired horizontal planar orientation of platen 38. The carriage 34 is driven through a sprocket and chain by motor 54 as shown in FIG. 2. The speed of translation may be varied in the range of one to eight inches per second.

Carriage 34 is disposed in a generally horizontal planar orientation during translation along rail 44 and track 48 over the functional stations driven by motor 54 through well-known sprocket and chain means (not shown) or other suitable means. Platen 38 is rotated 180 degrees by the action of drive motor 56 providing the sheet receiving surface 42 disposed upwardly so that an electrophotographic member conveniently can be installed on the platen 38.

Couplings 58 are capable of being slidably moved along the rail 44 carrying therewith the carriage 34 and platen 38. A wheel 60 is mounted on the carriage and rides on track 48 during motion of the carriage 34.

Figure 3:
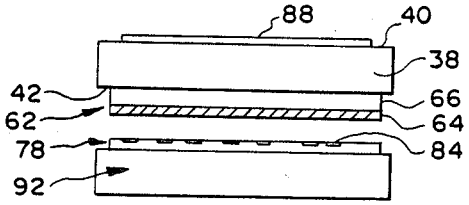
FIG. 3 is a diagrammatic detail of the platen of FIG. 1 and the copyboard of FIG. 2.

Referring to FIG. 3, an electrophotographic member designated 62 having a photoconductive layer 64 sputterdeposited on a conductive substrate 66 is secured onto the planar, sheet-receiving surface 42 of platen 38 by vacuum force supplied by vacuum pump 68. Additional means for retaining member 62 in place can be provided, such as by clamping or adhesive means (not shown). An electrophotographic member 62 such as described in U.S. Pat. No. 4,025,339 granted May 24, 1977 is utilized herein with advantage. A preferred electrophotographic member 62 is of the type in which the photoconductive layer 64 is deposited on a conductive substrate 66 and the photoconductive layer 64 is microcrystalline with the crystallites ordered and vertically oriented. The layer 64 exhibits single crystal characteristics. The layer 64 can be substantially less than two microns in thickness. The layer 64 has high quantum gain, capability of high speed discharge by light on the order of microseconds. Layer 64 is anisotropic electrically on its surface and has a surface resistivity of the order of $10^{20}$ ohm centimeters.

Copyboard module 70, shown in FIG. 2, is located under the home position of platen 38 within subchassis 50. Module 70 will be described hereinafter when the imaging station is considered.

Referring to FIG. 1, the charging station 26 is provided with a corona charging electrode 72. One preferred charging station 26 comprises an endless loop corona wire electrode 72 and a U-channel metal frame ground plane member 73. The electrode 72 preferably is disposed between pulleys 74, one of the pulleys 74 being coupled to a drive motor (not shown) for rotating electrode 72 so that a substantially uniform charge can be applied to the photoconductive surface 64. Electrostatic sensors such as electrometers 76 are arranged adjacent the wire 72 with high voltage D.C. power supply 78 connected to the electrode 72.

As the carriage 34 moves in a linear path along track 48 and rail 44, the photoconductive layer 64 is transported over the corona field and the electrometer sensors 76 at a predetermined distance therefrom. The electrometers 76 measure the charge on the photoconductive layer 64 which is provided as a meter reading. Feedback control responsive to said sensors 76 may be provided to the corona power supply circuit (not specifically illustrated) to assure that a proper uniform level of charge is applied to the photoconductive layer 64.

The polarity of the charge potential applied to the photoconductive layer 64 for imaging normally is negative since the photoconductive material of the electrophotographic member 62 is an n-type semiconductor, namely, cadmium sulfide. Accordingly, when the carriage 34 is translated past the charging station 26 in at least one full pass, a negative polarity corona can be generated to charge the layer to a predetermined level. The carriage 34 then is returned to the home position at the imaging station 24.

At the imaging station 24, the downwardly facing charged photoconductive layer 64 is exposed to radiant energy through a color separated transparency 78 from an energy source 80 through a projection system designated 82 located within said imaging station and located below the said layer and transparency (FIG. 3). The transparency 78 carries an image of a color separated original in an emulsion side 84 thereof. The apparatus 10 enables either imaging with the emulsion side 84 of transparency 78 engaged against the charged photoconductive layer 64 or with emulsion side 84 facing away from the photoconductive layer 64. The transfer station 30, as will be described in detail, enables a correct reading proof or print copy to be produced with either selected orientation of the emulsion side 84 of transparency 78.

Platen 38 next is translated horizontally to the toning station 28 where the electrostatic latent image of the pattern carried by said transparency 78 is developed or toned. Toning is effected with assistance of an electrical bias voltage and may require one or more passes of platen 38 past toning station 28. After completion of the toning step, photoconductive layer 64 carrying the toner image is translated to the image transfer station 30 where the toner image is transferred to pre-wet intermediate or offset medium 86 or directly to a pre-wet, transfer medium 88. Transfer is assisted by application of an electrical bias voltage during the transfer process. Once transfer has been completed, carriage 34 is returned to the home position.

During translation to the home position, platen 38 passes the cleaning station 32 where any residual toner particles remaining on the photoconductive layer 64 are removed, e.g. by a roller application of clear electrical insulating liquid. A squeegee or the like may be employed for wiping photoconductive layer 64 thereafter.

Platen 38 also will pass a radiant energy lamp 90 in returning to the home position to discharge photoconductive layer 64 of any residual charge. The radiant energy lamp 90 preferably is of the incandescant type.

Photoconductive layer 64 is charged to the magnitude desired; then the carriage 34 is driven by motor 54 along track 48 and rail 44 transporting platen 38 over the copyboard designated 92 at the imaging station 24.

Figure 8:
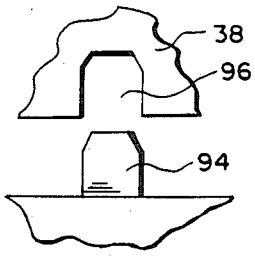
FIG. 8 is a fragmentary diagrammatic detail illustrating the registration means employed at both the imaging and the transfer stations of the apparatus.

Referring to FIG. 8, the copyboard 92 is provided with the upstanding pins 94 at locations about the transparency-receiving surface thereof. Matching sockets 96 are formed on surfaces 40,42 of the platen 38. The color-separation transparency 78 is provided with registration holes and is mounted on the copyboard 92 with the pins 94 engaged through and registration holes.

Obviously, color proofs are formed by successively sequentially imaging sets of color separation one on the other. This clearly requires the registration described herein and is inherent in the operations described herein, although the successive operations are described in connection with imaging of one color separation transparency at a time.

When the charged photoconductive layer 64 is over imaging station 24, the copyboard 92 is raised to an elevated position whereby transparency 78 is sandwiched engaged between layer 64 and face 42 of platen 38. Pins 94 are engaged within the sockets 96 to assure registration. A lift motor 98 is coupled to copyboard 92 to lift the copyboard 92 to its elevated position. A vacuum is drawn between the copyboard 92 and electrophotographic member-receiving surface 42 of platen 38 so that the layer 64 and transparency 78 sandwiched therebetween is forced into an intimate engagement. A roller 100 is located within the copyboard assembly 92 and below transparency 78. Roller 100 is arranged to be translated across the undersurface of the copyboard 92.

Roller 100 extends across the width of the copyboard 92 parallel thereto and rotates about its longitudinal axis as it is translated along the length thereof. Roller 100 is arranged generally biased against the copyboard 92 to exert an upwardly directed force against transparency 78, thereby to remove any air trapped between the juxtaposed face of transparency 78 and the charged photoconductive layer 64.

A suitable folded type projection system 82, including radiant energy source 80 and mirror 102, is disposed at the imaging station 24 within the housing 14 and below the copyboard 92. A useful light source 80 can be a high intensity, compact filament lamp, such as a General Electric type 100 TB/ISC 100 watt lamp, mirror 102 effectively distributing radiant energy to the transparency 78 from source 80 regulated to provide a predetermined amount of radiant energy.

The toning station 28 includes four self-contained, mechanically interchangeable, like toning modules 104, one for each liquid toner of the four primary toner colors, yellow, cyan, black, and magenta. However, the number of modules can be varied as desired.

The toning modules 104 are substantially identical and are slidable along a ball slide arrangement 106 mounted across the width of the subchassis 50 for removal and replacement, say for cleaning and for repair and/or servicing. The desired toner color may be selected manually at the beginning of a cycle. The selection may be preprogrammed for automatic operation. Each toning module includes a toner tray 108, a toner circulating pump (not shown), a toning development electrode 110 mounted across the top of the tray 108, a toner tray lift motor (not shown) and an articulated linkage secured to the undersurface of the tray and to the lift motor. The common vacuum pump 68 can be seated on base 20 coupled to an elongate manifold 112 for drawing a vacuum at each toner module via negative pressure nozzle 114 which extends along the length of toner tray 108 and adjacent thereto as shown in FIGS. 1 and 2. The vacuum nozzle 114 is arranged to suck up any excess liquid toner remaining on the layer 64 after a pass has made across the toning module 104.

The toner circulating pump (not shown) constantly agitates and recirculates the liquid toner 116 throughout the interior of tray 108 to keep the toner particles thereof dispersed. The circulating pump is of the low shear type and is located exterior of the toner tray 108 in order to minimize the temperature rise of the liquid toner 116.

The toner tray 108 containing the selected color toner 116 is raised to an elevated position by the lift motor. The lift motor may be small, a 0.01 horse power gear motor being adequate. A pair of anti-friction slides 118 (FIG. 1) are secured to opposite ends of toning development electrode 110 extending a predetermined distance above the planar top surface of electrode 110 to effect a typical 0.015 inch toning gap between development electrode 110 and photoconductive layer 64.

The development electrode 110 is spring mounted to have limited movement although it is biased outward of the tray 108. When platen 38 is translated into toning station 28, its leading edge engages the anti-friction slides 118 displacing the development electrode 110 downward against its normal bias. Thus, the toning gap is established and maintained during the passage of platen 38 over electrode 110. Liquid toner 116 is caused to flow across the development electrode 110. The latent electrostatic image on the photoconductive layer 64 may be fully toned in at least one pass of platen 38 over the development electrode 110 having the toner 116 flowing thereacross.

Liquid toner 116 contains toner particles dispersed in an electrically insulating fluid dispersant, such as the hydrocarbon sold by Exxon Company of Houston, Tex. under the trademark ISOPAR. Minute residual potentials or noise voltage attract small amounts of toner particles, or the dispersant may evaporate and the toner particles mechanically fall on photoconductive layer 64, producing background fog. A low electrical bias voltage of the order of two volts D.C. is applied between the development electrode 110 and the photoconductor layer 64 to minimize the background fog effect of any residual toner. Clear electrical insulating liquid 120 can be dispensed over layer 64 before platen 38 enters the toning station 28 to significantly reduce background fog. Carriage 34 and platen 38 are translated toward the transfer station 30 after toning is completed.

Figure 4:
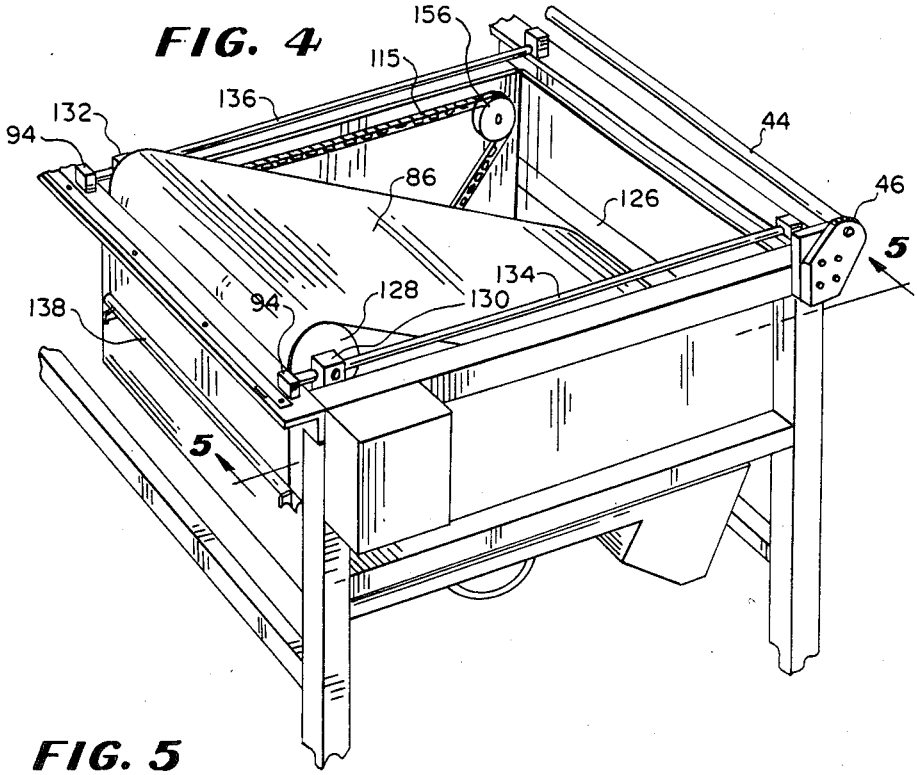
FIG. 4 is a fragmentary perspective view illustrating the transfer station of the apparatus of FIG. 1.
Figure 5:
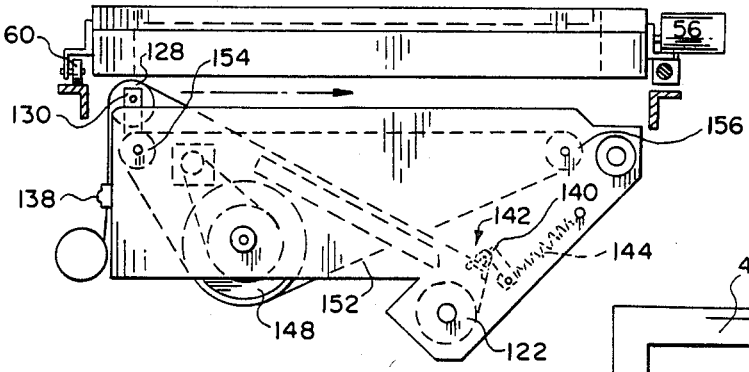
FIG. 5 is a fragmentary sectional view taken along the line 5—5 of FIG. 4 and in the direction indicated generally.
Figure 6:
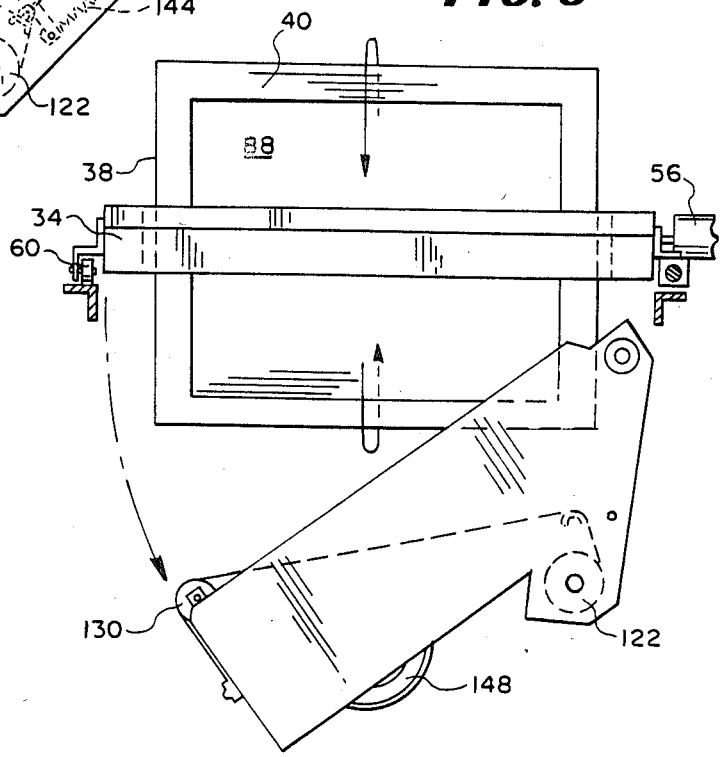
FIG. 6 is a fragmentary elevational view of the transfer station and illustrating one position of operation thereof.

Referring to FIGS. 4, 5 and 6, the transfer station 40 is illustrated in detail. The transfer station 30 is selectively operable to provide either an offset or direct transfer of the toner image to medium 88. If during the imaging function the emulsion side 84 of the transparency 78 is physically engaged against the charged photoconductive layer 64 to produce a correct reading print or color proof, the toner image must be transferred to an offset or intermediate medium 86 and subsequently transferred to the final transfer medium 88.

Considering first the offset transfer mode of operation for transfer station 30, the intermediate medium 86 is mounted in the transfer station 30. Intermediate medium 86 can be a paper web material provided on a roller 122 with a take-up roller 124 acting to retain the expended material after image transfer therefrom prior to discarding. Alternatively, the intermediate medium 86 can be provided in sheet form. The transfer medium 88 which can comprise the user's typical printing paper or the like (e.g., ordinary printing stock), can be mounted on the upper, sheet-receiving surface 40 of platen 38 and can be secured thereto in a similar manner as the electrophotographic member 62 is secured to the lower, planar surface 42 of platen 38. Intermediate medium 86 can also comprise the user's paper or the like, particularly when the apparatus is operated in the direct transfer mode. The intermediate or offset medium 86 and the transfer medium 88 are pre-wetted with electrical insulating fluid 120 prior to transferring the toner image thereto. The pre-wet mechanism 126 diagrammatically illustrated in FIG. 4 could be a plurality of spray mechanisms similar to those used for spray painting or one of a variety of mechanisms capable of providing a mist of fluid 120 over the entire surface of intermediate medium 86 and transfer member 88 prior to image transfer thereto. The electrically insulating fluid 120 can be the same isoparaffinic hydrocarbon fraction sold by Exxon Company of Houston, Tex. under registrated trademark ISOPAR that is used as the toner dispersant.

Prewetting is employed to avoid uneven absorption of the wet toner suspension from the photoconductive layer 64 thereby serving as a lubricant to assure uniform image transfer without blotches. The platen's registration sockets 96 are provided on both planar surfaces 40, 42 and are engaged by registration pins 94 during the transfers.

A conductive rubber transfer roller 128 extends across the width of the transfer station 30 parallel thereto. Roller 128 is disposed between couplings 130, 132. Couplings 130, 132 are capable of being slidably moved along the rails 134, 136 carrying therewith the transfer roller 128. Pneumatic clamps 138, 140 are provided to hold intermediate medium 86 at both ends thereof during transfer. Clamps 138, 140 can be rubber tubes inflated over the entire width of medium 86 at the two ends. The outer end of medium 86 designated 142 is held in tension by means of a constant force spring 144.

Drive motor 146 is coupled to pulley 148 through endless belt 150. Endless belt 152 is disposed between pulleys, 154, 156 and pulley 148. Pulley 154 is attached to coupling 130 whereby the action of motor 146 causes transfer roller 128 to move. The direction of travel of transfer roller 128 is indicated by an arrow in FIG. 5 and is orthogonal to its axis of rotation. The extension of transfer roller 128 presses the intermediate transfer medium 86 into intimate contact with the electrophotographic member 62 while a relatively high positive voltage on the order of 500 to 3000 volts d.c. is applied to prevent image shift during the member 86 lay-out over the image. A negative voltage on the order of 500 to 2500 volts D.C. is applied during return or retraction of the transfer roller 128. The high intensity electric field which is induced proximate with the line contact break between the transfer roller 128 and layer 64 as enhanced by the mechanical separation rate therebetween as related to the well understood DV/DT equation brings about the transfer at the toner pigments from the photoconductor layer 64 to medium 86. Hot air dryer fans 158 act to dry or evaporate any remaining fluid 120 on medium 86.

Referring to FIG. 6, there is illustrated the transfer means in a lowered position. After the image transfer to the intermediate medium 86 is completed, the transfer station 30 is lowered to allow rotation of platen 38. The drive motor 56 is activated to cause platen 38 to rotate through 180 degrees so that the transfer medium 88 faces downwardly toward the interior of housing 14. The transfer means are raised to the normal position to provide the final transfer of the toner image from the intermediate medium 86 to the transfer medium 88. The transfer roller 128 is extended and retracted concurrently with the application of a holding and a transfer voltage, respectively, as above described for the offset transfer. Motor 56 is activated to rotate the platen 38 through 180 degrees, returning the platen 38 to its normal operation.

After the image transfer is completed, the carriage 34 is driven by the motor 54 back along track 48 and rail 44 transporting platen 38 over the copyboard 92 at the imaging station 24. During the return travel, the photoconductive layer 64 is cleaned.

The first operation in cleaning the photoconductive layer 64 is to discharge layer 64 by exposure to a source of light 90. This facilitates the removal of toner 116 through discharge of residual electric affinity between layer 64 and toner 116. The cleaning station 32 is illustrated in FIGS. 1 and 2. The cleaning function is provided by a motor driven roller 160 disposed in a first bath 162, two motor driven counter-rotating rollers 164, 166 disposed in a separate second bath 168 and a cleaning vacuum nozzle 170. The rollers 160, 164, 166 are immersed in electrical insulating liquid 120, the same type of liquid employed to prewet the offset medium 86 and transfer medium 88, same being held in container 172 having a wall 174 separating the first bath 162 from the second bath 168. Container 172 is mounted on an articulated linkage (not shown) so that it normally is at a lowered position (inactive) until triggered by the return translation of the carriage 34 after transfer is complete. Cleaning station 32 is raised, elevating wetted rollers 160, 164, 166 into contact engagement with the photoconductive layer 64. A vacuum can be applied at vacuum nozzle 170 to remove remaining insulating liquid 120 from layer 64. After vacuuming is completed, layer 64 is ready to proceed with the next color imaging cycle for achieving the full color proof copy.

Figure 7:
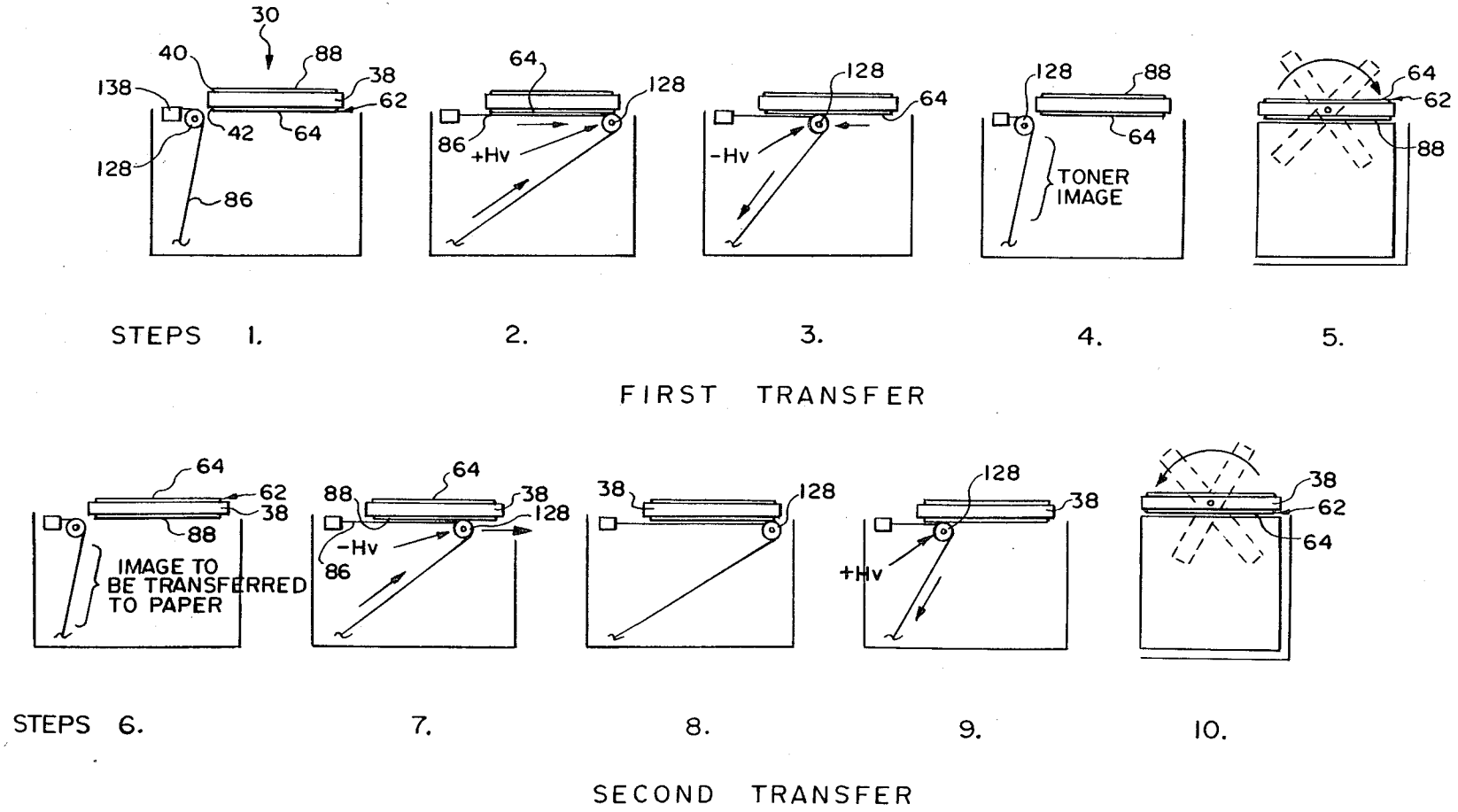
FIG. 7 is a diagrammatical view showing the transfer station in its sequential positions of operation for either direct or offset transfer according to the invention.

Referring to FIG. 7, the transfer process according to the invention is diagrammatically illustrated. The operator initially makes the selection for the offset or direct transfer which depends on the selected orientation of the transparency 78 during imaging. For the direct transfer mode, the intermediate transfer medium 86 preferably is formed of the same material that is used by the printer and only steps 1 through 4 of FIG. 7 would be practiced. For the offset transfer mode, the transfer medium 88 is mounted on the upper planar surface 40 of platen 38 and steps 1–10 of FIG. 7 would be practiced.

Step 1 illustrates platen 38 disposed over the transfer station 30. The transfer medium 88 is secured to the upper planar surface 40 of platen 38. The electrophotographic member 62 is secured to the lower, planar surface 42 of platen 38 having the photoconductive layer 64 facing downwardly toward the interior of having 14. A conductive transfer roller 128 engages the intermediate transfer medium 86. A prewet mechanism 126 provides a mist of fluid 120 to evenly saturate the surface of the intermediate medium 86.

Step 2 illustrates the translation of tranfer roller 128 pressing intermediate transfer medium 86 into intimate transfer engagement with layer 64 while a positive high voltage is applied to prevent image transfer.

Step 3 illustrates the return translation of roller 128 while a negative high voltage is applied to facilitate transfer of the toner image from layer 64 to medium 86.

Step 4 shows transfer roller 128 returned to its starting location and the first transfer of the toner image is completed. Thus, Steps 1 through 4 achieve direct transfer of the toner image to the transfer medium.

We consider offset transfer after steps 1 through 4 have been practiced as heretofore described. Step 5 illustrates platen 38 being rotated through 180 degrees so that transfer medium 88 faces inwardly of housing 14.

Step 6 illustrates the transfer medium 88 in position for transfer of the toner image thereto. Transfer medium 88 is pre-wetted with insulating fluid 120.

Step 7 illustrates the translation of transfer roller 128 pressing intermediate medium 86 into intimate transfer engagement with transfer medium 88 while a positive high voltage blocking image transfer is applied.

Step 8 shows transfer roller 128 translated over the full length of transfer station 30.

Step 9 illustrates the return translation of roller 128 while a negative high voltage is applied to facilitate transfer of the toner image from intermediate medium 86 to transfer medium 88.

Step 10 illustrates platen 38 being rotated through 180 degrees subsequent to completion of the final step for the offset transfer mode. Platen 38 is returned to its normal orientation with electrophotographic member 62 facing inwardly of housing 14. Offset transfer has been completed.

For the direct transfer mode, in Step 1 of FIG. 7, the intermediate transfer medium 86 preferably would be formed of the same material from which transfer medium 88 is formed and hence would comprise the print copy when the toner image is transferred thereto. In said direct transfer mode, the transfer medium 86 could be mounted on clamp 138 and disposed over transfer roller 128. In Step 2, roller 128 presses said transfer medium 86 into intimate transfer engagement with layer 64 while a positive high voltage is applied to prevent transfer on the toner image. In Step 3, roller 128 retracts while a negative high voltage is applied to facilitate transfer of the toner image from layer 64 directly to transfer medium 86. Step 4 illustrates the completion of the transfer in the direct transfer mode. Carriage 34 and platen 38 are translated toward the home position after transfer is completed.

What it is desired to secure by Letters Patent of the United States is:

1. An electrophotographic imaging apparatus for producing a print copy of a graphics image selectively either by direct transfer mode or offset transfer mode on a transfer medium from a transparency positioned in the apparatus in close proximity to an electrophotographic member having a photoconductive layer arranged to be sequentially translated along a linear path from functional station to functional station whereat to be charged at a charging station and exposed to radiant energy transmitted through said transparency at an exposure station to produce a latent image on said layer which can be toned at a toning station and the toner image thereafter transferred at a transfer station to said transfer medium to provide said print copy, the transparency having an emulsion side; said apparatus comprising:

A. platen means carrying the electrophotographic member mounted on one surface thereof, including support surface means capable of mounting a transfer medium at the transfer station on a second surface thereof, said platen means being movable in the linear path as the electrophotographic member is translated;

B. means for electrostatically charging the photoconductive layer;

C. means for exposing the charged layer to radiant energy while the transparency and electrophotographic member are proximate whereby to produce the latent image, said exposure means including means for transmitting the radiant energy from a source thereof;

D. means for applying a toner material to the latent image after such exposure to radiant energy; and D. the transfer station being located to receive said platen means after the toner image is produced on the electrophotographic member carried thereon for selectively transferring the toner image to a transfer medium, the transfer station including:

(1) transfer means operable alternatively in a direct transfer mode and in an offset transfer mode which also includes an intermediate transfer medium constructed and arranged to be selectively positioned first for initially receiving the toner image and for offset transfer mode operation, thereafter the toner image being transferable from said intermediate transfer medium to the transfer medium.

2. An apparatus as claimed in claim 1 in which said intermediate transfer medium is formed of a material suitable for providing the print copy in the direct transfer mode.

3. An apparatus as claimed in claim 1 and means for cleaning the photoconductive layer subsequent to image transfer therefrom.

4. An apparatus as claimed in claim 1 and means for pre-wetting both said intermediate transfer medium and the transfer medium prior to transferring the toner image thereto.

5. The apparatus as claimed in claim 1 and electrical bias means at the transfer station effective to apply a bias voltage of a selected polarity during transfer of the toner image.

6. The apparatus as claimed in claim 1 wherein the transparency has an emulsion side carrying the image, said emulsion side being disposable against said charged photoconductive layer when said charged photoconductive layer is in contact engagement with the transparency and said means for transferring the toner image is selectively provided for transferring the toner image from the photoconductive layer to said intermediate transfer member and thereafter to the transfer medium as the print copy.

7. The apparatus as claimed in claim 1 in which the transparency has an emulsion side which carries the image, the transparency being positioned with the emulsion side facing away from said charged photoconductive layer when said charged photoconductive layer is in contact engagement with the transparency and said means for transferring said toner image is effective to transfer the toner image directly from the photoconductive layer to the intermediate transfer medium.

8. The apparatus as claimed in claim 1 wherein the photoconductive layer comprises a thin uniform coating of a wholly inorganic microcrystalline material with the crystallites highly ordered, vertically oriented, the layer exhibiting single crystal characteristics, the layer being less than two microns in thickness, having high quantum gain, being capable of discharge by radiant energy at high speed on the order of microseconds, being anisotropic electrically on its surface and having a surface resistivity of the order of $10^{20}$ ohm centimeters.

9. The apparatus as claimed in claim 1 in which said platen means comprise a platen having first and second generally planar parallel surfaces the second surface functioning as the support surface means and means rotatably mounting said platen for rotation through 180 degrees.

10. The apparatus as claimed in claim 9 in which said electrophotographic member is secured to said first planar surface of said platen with the photoconductive layer facing downwardly.

11. The apparatus as claimed in claim 10 in which the transfer medium is secured to said second planar surface.

12. The apparatus as claimed in claim 1 wherein said transfer means include means for translating said intermediate transfer medium into intimate transfer engagement with the photoconductive layer and thereafter in engagement with the transfer medium during the offset transfer mode.

13. The apparatus as claimed in claim 12 and means for mounting said intermediate transfer medium including a pneumatic clamping means provided at the two ends of said intermediate transfer medium.

14. The apparatus as claimed in claim 12 and means for drying both said intermediate transfer medium and the transfer medium subsequent to transfer of the toner image respectively thereto.

15. The apparatus as claimed in claim 12 and means for mounting said intermediate transfer medium comprising an intermediate transfer medium supply for holding said intermediate transfer medium, said intermediate transfer medium comprising a sheet material having at least a leading end, transfer roller means mounted proximate the plane of travel of said platen means, said leading end being arranged in a path over said transfer roller means and means for securing said leading end.

16. The apparatus as claimed in claim 15 wherein said intermediate transfer medium is immobilized during transfer.

17. The apparatus as claimed in claim 15 in which said intermediate transfer medium comprises paper sheet material and said means for securing said leading end comprise pneumatic clamping means.

18. The apparatus as claimed in claim 15 in which said intermediate transfer medium comprises a continuous web of sheet material, and take-up means constructed and arranged to receive said leading end and securing means arranged to couple said leading end to said take-up means, said intermediate transfer medium being immobilized during transfer.

19. The apparatus as claimed in claim 18 and means for drying said intermediate transfer medium and said transfer medium subsequent to image transfer respectively thereto.

20. The apparatus as claimed in claim 1 wherein said intermediate transfer medium comprises paper sheet material.

21. The apparatus as claimed in claim 1 wherein said intermediate transfer medium comprises paper web material.

22. The apparatus as claimed in claim 1 wherein the transfer medium comprises paper sheet material.

23. An electrophotographic imaging apparatus for producing a print copy of a graphics image selectively either by direct transfer mode or offset transfer mode on a transfer medium from a transparency carrying the graphic image comprising:

A. a radiant energy-excluding housing having a framework;

B. a platen assembly mounted on the upper part of said framework and means for moving the platen assembly in a predetermined path;

C. said platen assembly including a platen having at least a support surface;

D. an electrophotographic member having a photoconductive layer secured to said support surface of said platen with said photoconductive layer being exposed to the interior of said housing;

E. a plurality of stations along the path comprising a charging station, an imaging station, a toning station, an image transfer station and a cleaning station, the apparatus including means for moving the platen assembly in a program bringing the same to and past said stations in a predetermined sequence whereby to have functions performed at the respective stations;

F. a copyboard disposed at said imaging station, said copyboard having a transparency-receiving surface within the housing arranged in face-to-face alignment with and parallel to said platen below the same when said platen assembly is at said imaging station, the copyboard being mounted to said framework and there being means for shifting said copyboard on said framework between a first position in which said transparency-receiving surface is spaced below said photoconductive layer and a second position in which said transparency-receiving surface lies substantially in the same plane as said photoconductive layer whereby, when said support surface carries an electrophotographic member the copyboard carries the transparency and the platen assembly is at said imaging station, the transparency will be in contact engagement with the charged photoconductive layer when said copyboard is in said second position, G. means at said imaging station for exposing said photoconductive layer when it contact with the transparency on said copyboard to radiant energy from a source thereof through the transparency to form a latent image of the graphics image on said photoconductive layer, H. said charging station having corona means for applying a charge to said photoconductive layer as the photoconductive layer passes said charging station prior to movement of said platen assembly to said imaging station, I. said toning station having a toning module including a development electrode, means for holding a store of toning fluid, means for depositing toning fluid on said electrode, said toning module being disposed with said electrode directed upward and at a level to provide contact between toning fluid carried by said electrode and said photoconductive layer when any part of said platen is at said toning station whereby all of said layer will be contacted when the platen assembly passes through said toning station thereby forming a toner image, J. said image transfer station comprises an intermediate transfer medium, means for mounting said intermediate transfer medium within said image transfer station, means for effecting intimate transfer engagement between said photoconductive layer and said intermediate transfer medium, means for effecting transfer of said toner image from said photoconductive layer to said intermediate transfer medium, means at the transfer station to provide a second support surface mounting a transfer medium capable of being cooperatively engageable with the intermediate transfer medium to enable receipt of the toner image on the transfer medium from the intermediate transfer medium whereby at the transfer station there is made available a support for the transfer medium so both direct and offset transfer are capable of being achieved in the absence of material change of the apparatus, and means for prewetting at least one of said intermediate transfer medium and the transfer medium, and K. said cleaning station having means for cleaning said photoconductive layer subsequent to toner image transfer.

24. The apparatus as claimed in claim 23 and said platen being capable of being rotated through 180 degrees and an intimate engagement being established between said intermediate transfer medium and the transfer medium for transfer of said toner image from said intermediate transfer medium to the transfer medium only during the offset transfer mode and subsequent to pivoting of said platen for placing the transfer medium in toner image receiving disposition.

25. The apparatus as claimed in claim 23 wherein more than one toner image is transferred sequentially in registry to one of the transfer medium and said intermediate transfer medium via the selected transfer mode.

26. The apparatus as claimed in claim 23 wherein the transparency has an emulsion side carrying the image and said emulsion side faces said charged photoconductive layer when the transparency is in contact engagement with said photoconductive layer.

27. The apparatus as claimed in claim 23 wherein the transparency has an emulsion side carrying the image and said emulsion side faces away from said charged photoconductive layer when the transparency is in contact engagement with said photoconductive layer.

28. An electrophotographic imaging apparatus for producing a print copy of a graphics art image carried by a transparency in an emulsion side thereof in which the apparatus includes a framework defining an internal area and means cooperating with said framework defining a light-tight housing, a platen having an electrophotographic member receiving surface mounted for translatory movement lengthwise along said framework in a predetermined path along a horizontal plane past a plurality of stations including a charging station, an imaging station, a toning station and a transfer station arranged sequentially within the housing and along said path, means securing an electrophotographic member on the platen, the electrophotographic member having a photoconductive layer and secured with the photoconductive layer facing inwardly of the housing, the imaging station having a copyboard having means for mounting the transparency thereon facing the photoconductive layer, means for establishing registration between the transparency and the electrophotographic member during engagement thereof, a source of radiant energy and means for projecting radiant energy through the engaged members subsequent to application of a charge potential to the photoconductive layer, the charging station being adjacent the imaging station and including corona generating means for applying the charge potential to the photoconductive layer, exposure of the charged surface to the radiant energy producing a latent electrostatic image of the pattern on the exposed surface, the toning station including means for depositing liquid toner to the photoconductive layer for depositing liquid toner to the photoconductive layer for rendering the latent electrostatic image visible, means for sequentially translating the platen along the predetermined path between the stations, the improvement comprising transfer means at the transfer station capable of selectively effecting transfer of the toned image by one of a direct transfer mode and an offset transfer mode to form the print copy, said transfer means comprising intermediate transfer means which also includes an intermediate transfer medium, and arranged to be selectively positioned for initially receiving the toner image and thereafter capable of transferring the toner image to the transfer medium to provide the said print copy in such offset transfer mode.

29. An apparatus as claimed in claim 28 wherein the platen is pivotable and is capable of being pivoted alternatively for application of the toner image to said intermediate transfer medium for subsequent transfer of the toner image to the transfer medium forming the print copy in the offset transfer mode.

30. The apparatus as claimed in claim 28 and means for pre-wetting said intermediate transfer medium and said transfer medium to receive a toner image.

31. In an electrophotographic imaging apparatus for producing a print copy of a graphics image on a transfer medium therein there is provided an electrophotographic member having a photoconductive layer and an electrostatic latent charge image representing the graphics image is formed on the photoconductive layer of the electrophotographic member carried by platen means mounted upon a movable carriage brought sequentially to a series of functional stations including a charging station, an exposure station, a toning station and a transfer station respectively, having charging means for electrostatically charging the layer, means for exposing the charged layer to form the latent image, means for applying toner material to the latent image and means for transferring the toner image to a transfer medium for forming said print copy respectively; the improvement comprising:

1. the platen means having opposite parallel surfaces and carrying said electrophotographic member on one surface and being capable of carrying the transfer medium on the opposite surface; and
2. the transfer station including means selectively operable for effecting the transfer of the toner image to form the print copy by one of a direct transfer mode and an offset transfer mode, said last mentioned means including intermediate transfer means which also include an intermediate transfer medium, constructed and arranged to be selectively positioned relative to the photoconductive layer for initially receiving the toner image and thereafter transferring same to the transfer medium in such offset transfer mode.

32. Apparatus as claimed in claim 31 and means for pre-wetting the toner image receiving medium prior to transfer of the toner image thereto.

33. Apparatus as claimed in claim 31 and means for cleaning any remaining residual toner from the photoconductive layer.

34. An electrophotographic imaging apparatus for producing a print copy of a graphics image selectively either by direct transfer mode or offset transfer mode on a transfer medium from a transparency positioned in the apparatus in close proximity to an electrophotographic member having a photoconductive layer arranged to be sequentially translated along a linear path from functional station to functional station whereat to be sequentially charged and exposed to radiant energy transmitted through said transparency to produce a latent image on said layer which can be toned and the toner image thereafter transferred to said transfer medium to provide said print copy, said apparatus comprising:

A. platen means carrying the electrophotographic member mounted on one surface thereof movable in the path from functional station to functional station whereby to translate the electrophotographic member therewith;
B. means for electrostatically charging the photoconductive layer at a charging station;
C. means for exposing the charged layer to radiant energy at an exposure station while the transparency and electrophotographic member are closely proximate whereby to produce the latent image, said exposure means including means for transmitting the radiant energy from a source thereof;
D. means for applying a toner material to the latent image at a toner station after such exposure to radiant energy; and
E. a transfer station located to receive said platen means after the toner image is produced on the electrophotographic member for selectively transferring the toner image to a transfer medium, said transfer station including
   (1) an intermediate transfer medium,
   (2) support surface means capable of mounting a transfer medium in position for cooperative engagement with the intermediate transfer medium when said platen means arrive at said transfer station,
   (3) transfer means operable alternatively in a direct transfer mode and in an offset transfer mode which also include said intermediate transfer medium constructed and arranged to be selectively positioned first for initially receiving the toner image from the electrophotographic member, said transfer medium being mounted for cooperative engagement with said intermediate transfer medium for the offset transfer mode operation whereby the toner image can be transferred from said intermediate transfer medium to said transfer medium for the offset transfer mode operation and retained for direct transfer mode operation.

35. A method of producing a print copy of a graphics art image from a transparency carrying said image in an emulsion side thereof using electrophotographic technique electively by one of direct and offset transfer modes, including the steps of providing an electrophotographic member having a photoconductive layer and securing same to a planar surface of a movable platen with the photoconductive layer facing outwardly; applying a charge potential to the photoconductive layer, establishing an intimate engagement of the transparency and said charged layer, forming a latent electrostatic charge image of the graphics art image by exposing said engaged transparency and charged layer to radiant energy from a source thereof; removing said transparency from contact with said photoconductive layer; toning said latent electrostatic charge image to form a visible toner image and transferring said toner image to a transfer medium forming the print copy, said method comprising the steps of providing an intermediate transfer medium at the transfer station, bringing the platen to the transfer station subsequent to formation of the toner image thereon, positioning the intermediate transfer medium into transfer proximity with the photoconductive layer carried on the platen and effecting transfer of the toner image to the intermediate transfer medium directly from the photoconductive layer and optionally transferring the aforementioned toner image from the intermediate transfer medium to the transfer medium.

36. The method as claimed in claim 35 and the step of mounting a transfer medium upon the platen on the surface opposite said planar surface and manipulating the platen to bring the transfer medium carried thereby into transfer proximity with the intermediate transfer medium and effecting transfer of the toner image thereon onto the transfer medium.

37. The method as claimed in claim 36 and the step of prewetting the transfer medium with an electrically insulating liquid before transfer of the toner image thereto.

38. The method as claimed in claim 36 and the steps of rotating the platen 180° after displacing the intermediate transfer medium from any interferent relationship with rotation of the platen to enable said rotation and returning said intermediate transfer medium to establish a transfer relationship between said intermediate transfer medium and the transfer medium and effecting transfer of the toner image from the intermediate transfer medium to the transfer medium carried by the platen.

39. The method as claimed in claim 35 and the step of pre-wetting the intermediate transfer medium with an electrically insulating liquid prior to effecting transfer of the toner image thereto.

* * * * *

UNITED STATES PATENT AND TRADEMARK OFFICE

CERTIFICATE OF CORRECTION

PATENT NO. : 4,556,309

DATED : December 3, 1985

INVENTOR(S) : HAROLD J. WEBER, et al

It is certified that error appears in the above-identified patent and that said Letters Patent are hereby corrected as shown below:

Column 16, Claim 28, line 49 should be deleted;

Column 15, line 17, "it" should read --in--;

Column 17, line 6 (claim 31) "therein" should be --wherein--.

Signed and Sealed this

*Eleventh* Day of *March 1986*

[SEAL]

*Attest:*

DONALD J. QUIGG

*Attesting Officer*

*Commissioner of Patents and Trademarks*